United States Patent [19]

Krall

[11] Patent Number: 4,951,858

[45] Date of Patent: Aug. 28, 1990

[54] WRAP DISPENSER

[76] Inventor: Kenneth Krall, P.O. Box 704, San Anselmo, Calif. 94960

[21] Appl. No.: 277,755

[22] Filed: Nov. 30, 1988

[51] Int. Cl.[5] ..... B65D 85/671

[52] U.S. Cl. ..... 225/19; 225/53; 225/77; 225/90

[58] Field of Search ..... 225/19, 20, 47, 48, 225/53, 77, 80, 90, 54

[56] References Cited

U.S. PATENT DOCUMENTS

| | | | |
|---|---|---|---|
| 3,739,964 | 6/1973 | Stine | 225/53 |
| 4,119,251 | 10/1978 | Golner | 225/20 |
| 4,252,258 | 2/1981 | Plummer, III | 225/91 |
| 4,474,318 | 10/1984 | Perrin | 225/48 |
| 4,715,519 | 12/1987 | Fischer | 225/48 |
| 4,844,310 | 7/1989 | Gelezivnas | 225/54 |

*Primary Examiner*—Hien H. Phan

*Attorney, Agent, or Firm*—Larry D. Johnson

[57] ABSTRACT

A wrap dispenser comprises a generally rectangular box structure having a base, front and back walls, left and right side walls, and a hinged top or lid. A roll containment wall is mounted parallel to but displaced a short distance inwardly from said front wall, and serves to define the forward side of a central cavity to hold a roll of commercially-available plastic wrap within the dispenser. The front wall holds a cutting blade, and the top edge of the front wall includes a blade recess portion narrower than the width of the blade. The lid includes a recessed front edge that is wider than the blade recess portion, but narrower than the front wall itself. The side walls include recessed upper corners to enable a user to reach into the separation area between the containment wall and the front wall.

2 Claims, 4 Drawing Sheets

WRAP DISPENSER

BACKGROUND OF THE INVENTION

1. Field of the Invention

This invention relates generally to food handling and packaging equipment, and more specifically to an improved container and dispenser device for plastic wrap and related material.

2. Description of the Prior Art

Plastic wrap, wax paper, aluminum foil, and related packaging and sealing material is typically manufactured in elongate sheets mounted on a roll. Such wrap material is usually dispensed by pulling a desired length of the wrap from the roll, and cutting the wrap against a blade or knife edge. Traditional dispensers simply contain the roll within a cardboard box-like structure, and mount a wrap-width blade on an exposed edge of one wall of the box. Unfortunately, such dispensers are usually weak and prone to deterioration, and additionally expose the user's hands to cuts against the exposed blade.

Other, more complicated wrap dispensers use a mechanical system, typically spring-actuated, to dispense a desired length of wrap, and incorporate a guard or other device to shield the user's hands from the cutting blade. However, these dispensers are prone to breakage of the mechanism, and jamming of the wrap itself in the dispenser.

SUMMARY OF THE INVENTION

The wrap dispenser of this invention provides a unitary container and dispenser for plastic film or wrap. The dispenser comprises a generally rectangular box structure having a base, front and back walls, left and right side walls, and a hinged top or lid. A roll containment wall is mounted parallel to but displaced a short distance inwardly from said front wall, and serves to define the forward side of a central cavity to hold a roll of commercially-available plastic wrap within the dispenser. Thus, the front wall is spaced a short distance from the roll of plastic wrap contained within this central cavity.

The front wall includes a slot or holder portion to accommodate a cutting blade, such as the commercially available cutting blade usually packaged with plastic wrap. The top edge of this front wall includes a blade recess portion extending across said top edge a distance less than the width of the cutting blade.

The lid is hinged to the back wall and extends forward to the front wall, and includes a shortened or recessed front edge that is wider than the front wall blade recess portion, but narrower than the front wall itself. Thus, when closed, the lid front edge rests on just two segments of the front wall top edge adjacent the blade recess portion.

The right and left side walls each bear a recessed upper front corner generally co-extensive with the lid recessed front edge. Thus, the combination of the lid recessed front edge with these side wall recessed upper corners enables a user to reach into the separation area between the roll containment wall and the front wall.

For use, the dispenser lid is lifted, a roll of plastic wrap is placed into the dispenser central cavity, the leading edge of the wrap is pulled out of the central cavity and laid upon the front wall, and the lid portion is placed back down on the front wall. The lid front edge contacts the front wall top edge on both sides of the blade recess portion, and serves to hold the wrap in position there. In addition, the separation area between the front wall and the roll containment wall prevents the wrap from falling back on to the roll.

To dispense a length of wrap, the user can reach a thumb and forefinger into each of the right and left separation areas betWeen the front wall and the roll containment wall, to grasp the exposed sides of the plastic wrap, and lift and pull the wrap up and away from the dispenser. The user's hands are protected from being cut on the blade since the front wall blade recess portion (exposing the blade) is narrower than the lid recessed front edge. When a desired length of wrap has been pulled from the dispenser, the user pulls the wrap down against the exposed blade to cut the wrap. The lid then falls back down to capture the leading edge of the remaining wrap against the front wall, as before, and the cycle can be repeated.

DETAILED DESCRIPTION OF A PREFERRED EMBODIMENT

Figure 1:
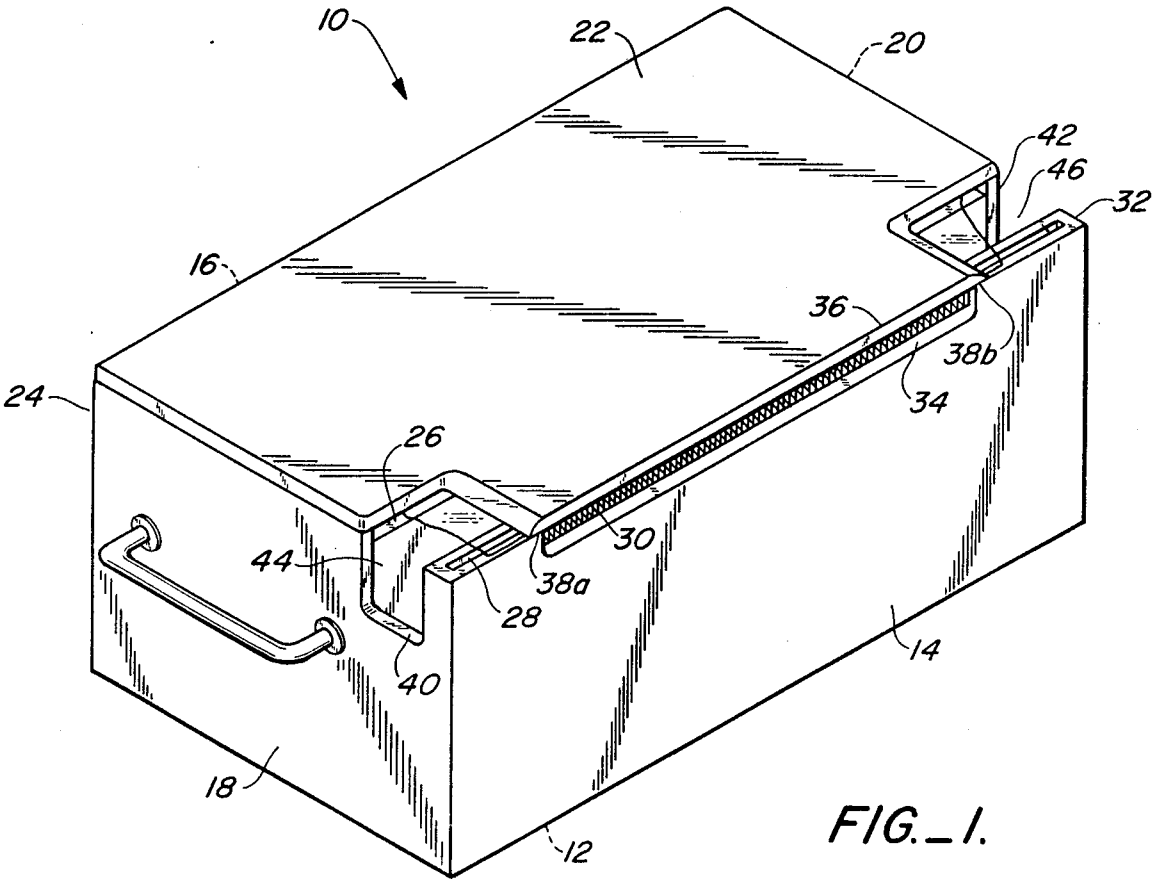
FIG. 1 is a perspective view of the wrap dispenser of this invention, with a roll of plastic wrap having been installed in the dispenser and ready for use.

FIG. 1 is a perspective view of the wrap dispenser 10 of this invention, with a roll of plastic wrap having been installed in the dispenser and ready for use. Dispenser 10 comprises a generally rectangular box structure having a base 12, front wall 14, back wall 16, left wall 18, right wall 20, and top or lid 22 attached to the back wall by hinge 24. A roll containment wall 26 is mounted parallel to but displaced a short distance inwardly from front wall 14, and serves to define the forward side of a central cavity to hold a roll of plastic wrap (not visible in this view) within the dispenser. Front wall 14 includes a slot or holder portion 28 to accommodate cutting blade 30. The top edge 32 of front wall 14 includes a blade recess portion 34 extending across the top edge a distance less than the width of the cutting blade. Lid 22 is hinged to the back wall and extends forward to the front wall, and includes a shortened or recessed front edge 36 that is wider than the front wall blade recess portion 34, but narrower than the front wall top edge 32. Thus, when closed, the lid front edge 36 rests on just two segments 38*a, b* of the front wall top edge 34 adjacent the blade recess portion 34. The right and left side walls each bear a recessed upper front corner 40, 42 generally co-extensive with lid recessed front edge 36. Thus, the combination of the lid recess front edge 36 with side wall recessed upper corners 40, 42 define a separation area 44, 46 on each side of the dispenser.

Figure 2:
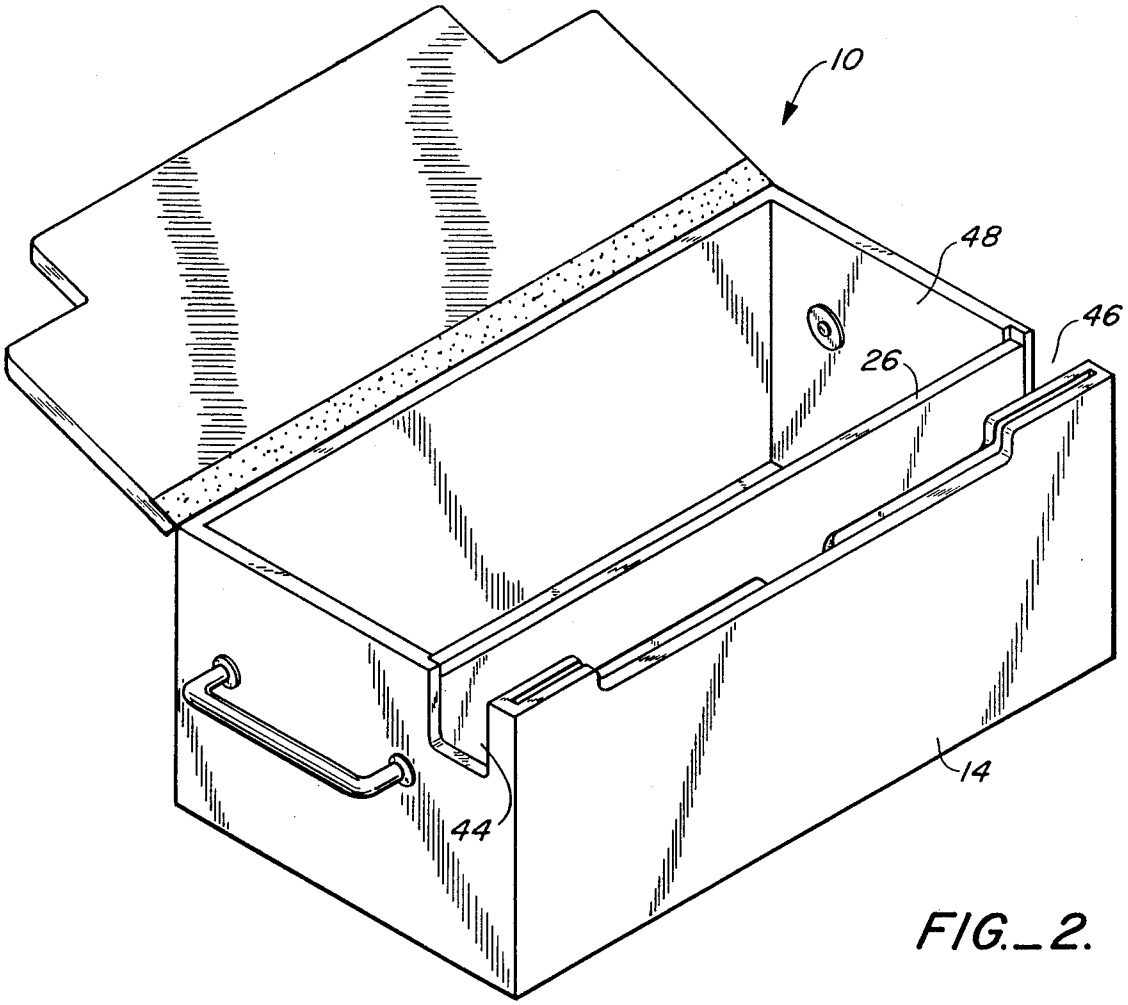
FIG. 2 is a view of the wrap dispenser of this invention, wit dispenser lid open and the roll of plastic wrap and blade removed.

FIG. 2 is a perspective view of the wrap dispenser 10 of this invention, with the dispenser lid open and the roll of plastic wrap and cutting blade removed. This view better illustrates the central cavity 48 defined by roll containment wall 26. Further, this view illustrates separation area 44, 46 between containment wall 26 and front wall 14.

Figure 3:
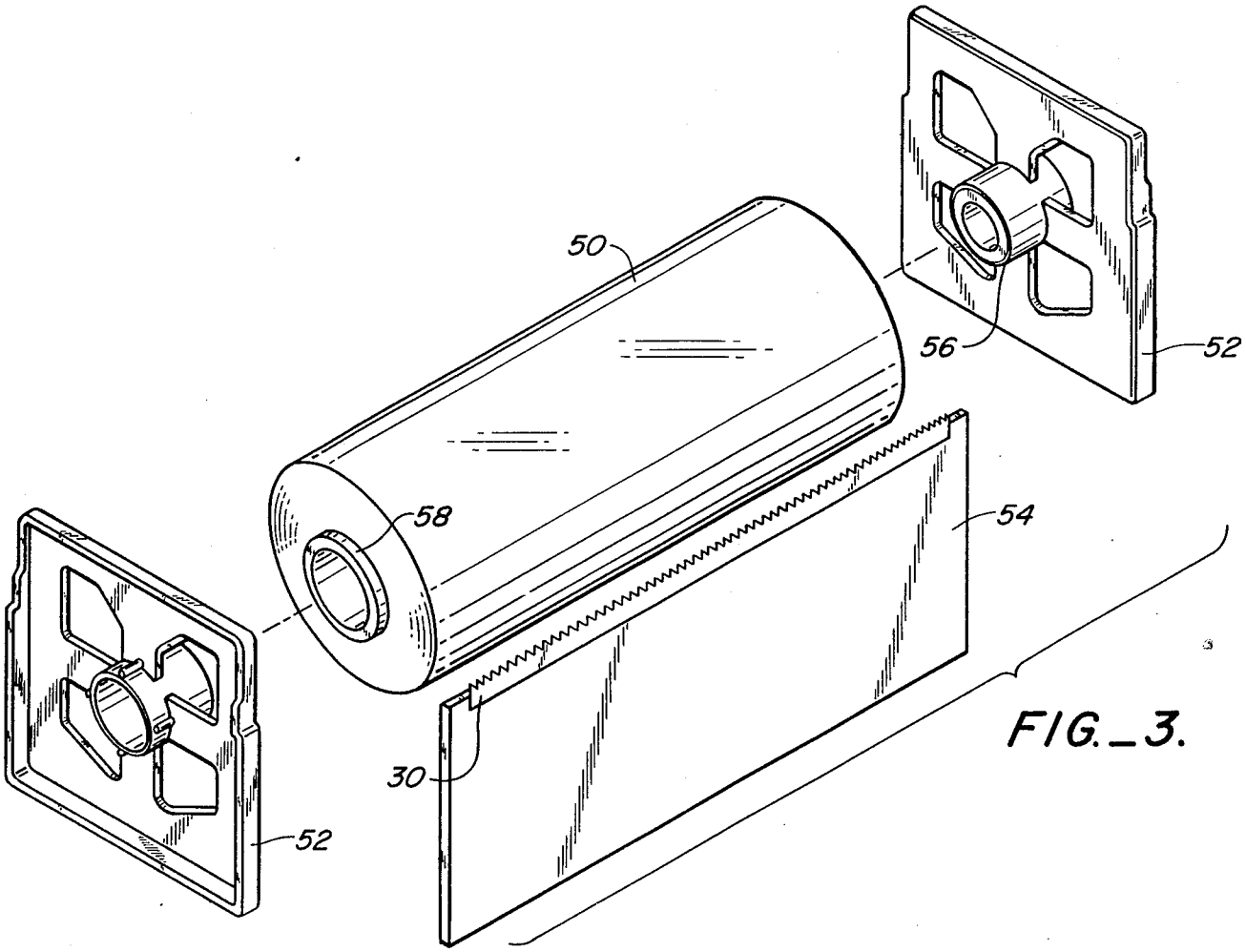
FIG. 3 is an exploded perspective view of the common existing components plastic wrap to be used in the wrap dispenser of this including the roll of plastic wrap itself, its roll and cutting blade card.

FIG. 3 is an exploded perspective view of the common existing components of the plastic wrap to be used in the wrap dispenser of this invention, including the roll of plastic wrap 50 itself, its roll end supports 52 and cutting blade card 54. End support 52 include center tube mounts 56 to support the center tube 58 of roll 50. Blade card 54 typically includes cutting blade 30 mounted on its upper edge.

Figure 4:
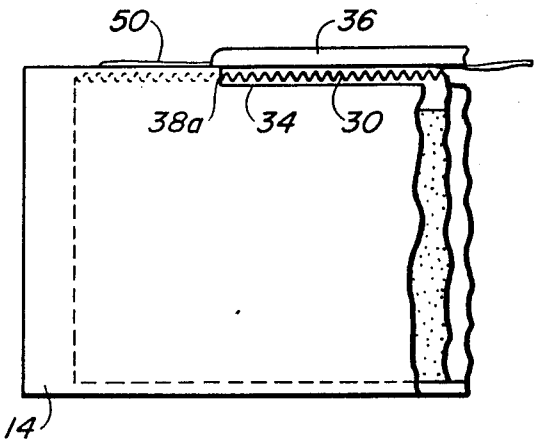
FIG. 4 is a cutaway front elevation of the front wall and lid of wrap dispenser of this invention, illustrating the contact of the lid with the front wall, and the capture of the adjacent the cutting blade.

FIG. 4 is a partially cutaway front elevation of the front wall 14 and lid front edge 36 of the wrap dispenser of this invention, illustrating the contact of the lid front edge with the front wall, and the capture of the plastic wrap 50 adjacent the cutting blade 30. This view also illustrates contact segment 38*a* adjacent front wall blade recess portion 34.

Figure 5:
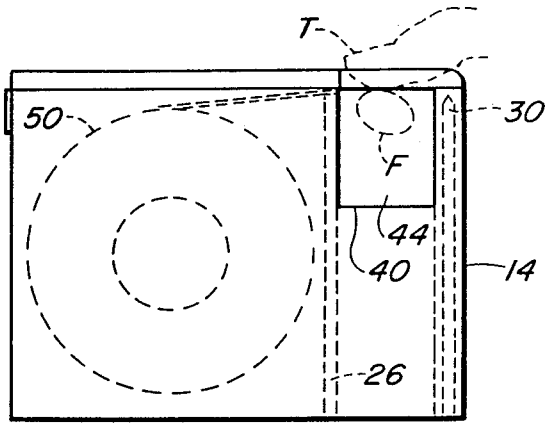
FIG. 5 is a side elevation view of the wrap dispenser of this invention, with roll of plastic wrap, roll containment wall, an blade illustrated in phantom, and showing a user's and finger grasping the plastic wrap for use.

FIG. 5 is a side elevation view of the wrap dispenser of this invention, with the roll of plastic wrap 50, roll containment wall 26, and cutting blade 30 illustrated in phantom, and showing a user's thumb T and finger F grasping the plastic wrap for use. This view also illustrates the separation area 44 between containment wall 26 and front wall 14, as defined by side wall recessed upper front corner 40.

Figure 6:
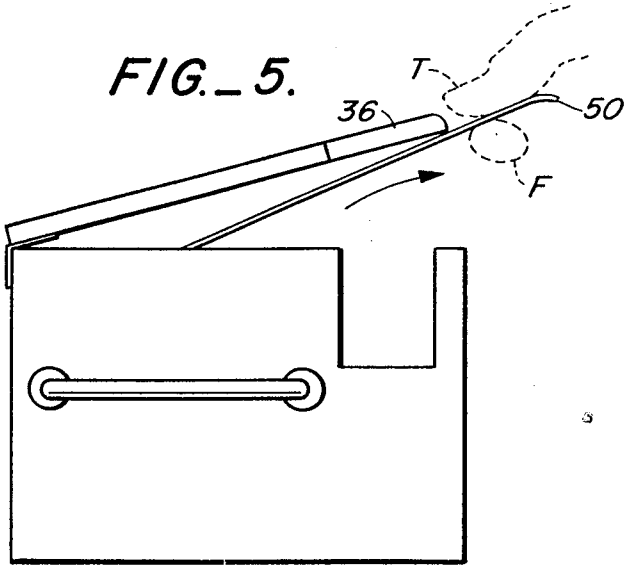
FIG. 6 is a side elevation view of the wrap dispenser of this invention, with the user's thumb and finger having pulled a length of plastic wrap from the dispenser, before pulling down. on the plastic wrap to cut it at a desired length against the cutting blade.

FIG. 6 is a side elevation view of the wrap dispenser of this invention, with the user's thumb T and finger F having pulled a length of plastic wrap 50 from the dispenser, before pulling down on the plastic wrap to cut it at a desired length against the cutting blade. This view also illustrates lid front edge 36 being lifted by the wrap, and the user's hands now safely away from the cutting blade area.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A wrap dispenser comprising:

a generally rectangular box structure having a front wall, left side wall, right side wall, and a top;

a roll containment wall mounted parallel to but displaced a short distance inwardly from said front wall, defining the forward side of a central cavity for holding a roll of wrap;

blade means for cutting wrap, said blade means carried on said front wall;

a blade recess area on said front wall for exposing only a portion of said blade means; and a recessed front edge on said top that is wider than said front wall blade recess area, but narrower than said front wall.

2. The wrap dispenser of claim 1 wherein said left and right side walls each bears a recessed upper front corner enabling access into the area between said roll containment wall and said front wall.

* * * * *